US005728013A

United States Patent [19]

Luther, Sr.

[11] Patent Number: 5,728,013

[45] Date of Patent: Mar. 17, 1998

[54] GOLF PRACTICE TEE

[76] Inventor: Walter C. Luther, Sr., Rte. 12, Box D-202, Lake City, Fla. 32025

[21] Appl. No.: 758,668

[22] Filed: Dec. 2, 1996

[51] Int. Cl.[6] ..... A63B 57/00

[52] U.S. Cl. ..... 473/396; 473/386

[58] Field of Search ..... 473/387, 392, 473/393, 394, 395, 396, 397, 398, 400, 401, 402, 403, 417

[56] References Cited

U.S. PATENT DOCUMENTS

| | | | |
|---|---|---|---|
| 1,679,579 | 8/1928 | Lundy | 473/396 |
| 2,884,250 | 4/1959 | Patterson | 473/417 |
| 3,633,919 | 1/1972 | Liccardello | 473/396 |
| 3,743,298 | 7/1973 | Reynolds | 473/395 |
| 4,976,431 | 12/1990 | Guenther | 473/398 |
| 5,085,431 | 2/1992 | McGuire | 473/398 |
| 5,386,987 | 2/1995 | Rodino, Jr. | 473/417 |
| 5,413,348 | 5/1995 | Basso | 473/393 |

*Primary Examiner*—Steven B. Wong
*Attorney, Agent, or Firm*—Arthur G. Yeager

[57] ABSTRACT

A golf practice tee device which includes a central rigid tubular body, a lower rigid spike portion, and a lengthwise adjustable upper flexible tubular golf ball support, and a detachably connected rod to install and remove the tee device from the ground. A brake is provided to restrict free movement between the body and the support and a stop may be included to restrict dissassociation therebetween. A simplified tee device has the support threaded onto the rod for vertical height adjustment.

17 Claims, 2 Drawing Sheets

6
3
3
6
22
19
15
18
17
16
10
20
14
13
14
11
12
21

22
15
16
17
10
20
14
13
11
12
21

31
30
32
33

32
33
31

GOLF PRACTICE TEE

TECHNICAL FIELD

This invention relates to equipment used to practice at golf driving ranges, and more specifically, relates to a semi-permanent golf tee which is sunken in the ground and provides a support tee for the golf ball.

BACKGROUND OF THE INVENTION

Golf driving ranges are well-known recreational locations in this country where a person may rent some golf balls and hit those golf balls from a teeing location into an open area or a range with any type of golf club. By using such a facility a person may practice many different types of golf shots, generally not including putting. Usually such a golf range is used principally for hitting long distance shots rather than short shots.

In my patent, U.S. Pat. No. 5,346,222, there is a disclosure of a device for automatically placing a golf ball onto a tee at home or on a driving range so as to eliminate the teeing operation between shots. In that patent there is a disclosure of a tubular magazine for storing a large number of golf balls aligned so as to be discharged one at a time onto a tee that holds the golf ball above the ground as on a tee, for the golfer to hit the ball with his golf club. When the golfer is ready for the next shot he moves a pivotable arm to cause the apparatus to deliver the next golf ball to the tee for the next shot, and so on, until the magazine empties itself of all golf balls. The tee shown in FIG. 6 of this patent is a rubbery tube projecting vertically above the ground level and available for receiving and holding in place a golf ball in the same general position that is provided by the wooden tees used in a golf game.

The present invention is a device to be used as the tee in the machine of my patent, U.S. Pat. No. 5,346,222, or it may be used separate from the machine of that patent. A tee is, of course, subject to repeated battering by the golf club used to strike the ball on the tee. Accordingly, the tee must be able to be placed firmly in the ground and the portion upon which the ball rests must be able to withstand repeated hits by a wooden or a metal golf club. The golf tee of this invention meets these requirements.

It is an object of this invention to provide a golf tee capable of acceptable repeated use in a golf driving range where golf balls will be hit from the tee which is embedded in the ground with only a small top portion above the ground level and capable of support a golf ball until hit. It is another object of this invention to provide a golf tee for semi-continuous use at a driving range and including a long spike to be buried into the ground and topped by a flexible rubber tube that projects above the ground level, is height-adjustable, and is capable of supporting a golf ball until it is hit into a driving range. Other objects will become apparent from the more detailed description which follows.

BRIEF SUMMARY OF THE INVENTION

This invention relates to a golf practice tee including a vertical tubular body having at its lower end a tapered connection to an elongated vertical spike and at its upper end adjustably extensible lengthwise. The body may be a flexible tubing or if rigid, to include a flexible tubing within a rigid body.

In preferred and specific embodiments of the invention the tapered connection joining the tubular body to the elongated spike is a conical plug of hard material surrounding the spike and held in place by a nut engaging threads on the spike.

Another embodiment of the invention involves an elastic rubbery tubing extending upwardly of the tubular body and serving as a tee to hold a golf ball above ground level; the rubbery tubing having adjustable lengthwise with respect to the vertical tubular body. In other embodiments the tubular body includes drainage holes through the body walls to prevent ground water collecting under the body and drainage of rain or irrigation water. The tee may include a brake means to restrict the free movement of the tubing with respect to the body and/or a stop means to limit the extent of relative movement between the tubing and the body.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figures 1, 2, 3, 4, 5:
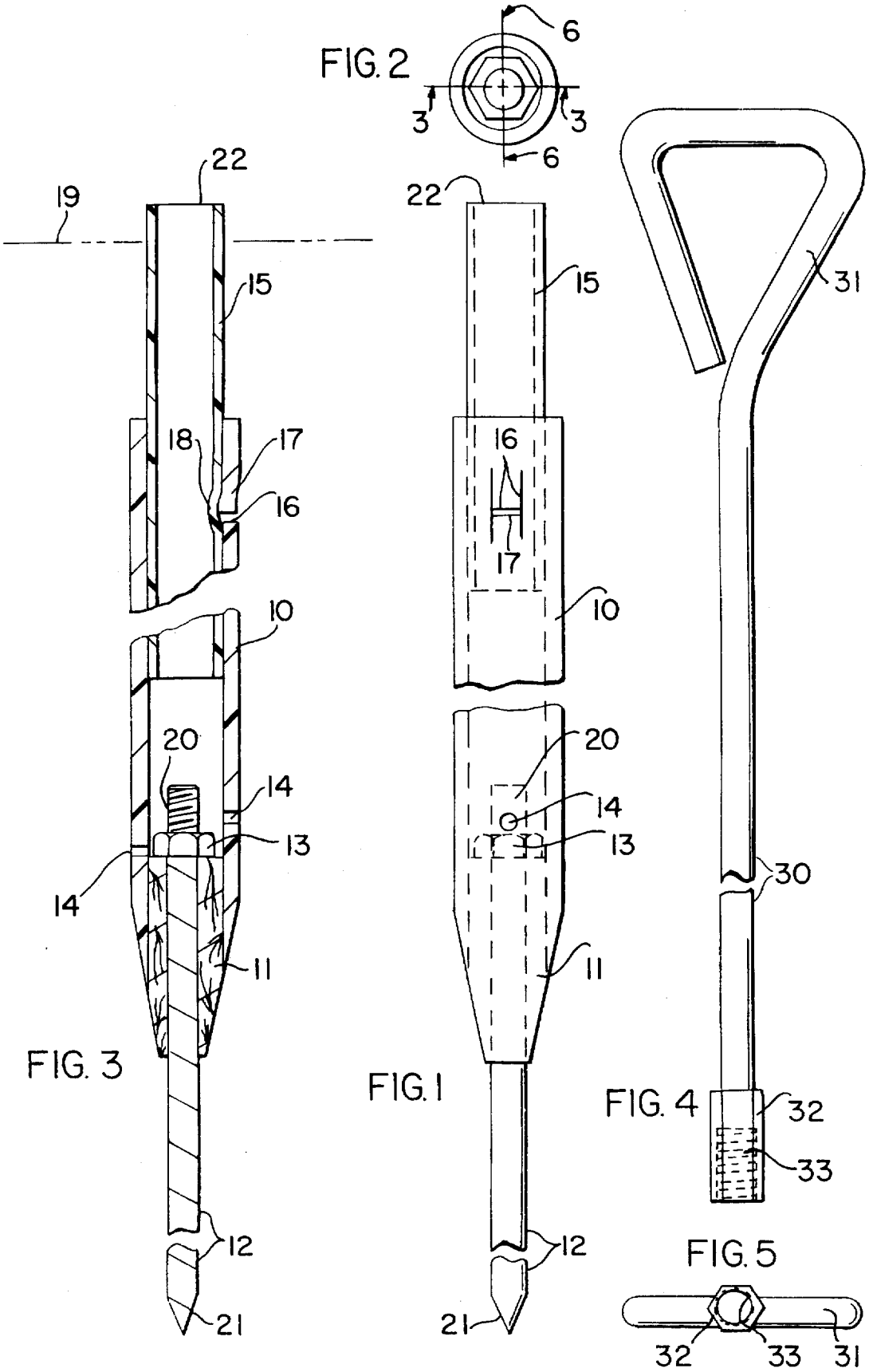
FIG. 1 is a front elevational view of the golf practice tee of this invention.
FIG. 2 is a top plan view of the golf practice tee of this invention.
FIG. 3 is a cross-sectional view of the golf practice tee of this invention taken at line 3—3 of FIG. 2.
FIG. 4 is a front elevational view of a tool employed to position in the ground the golf practice tee of FIGS. 1–3.
FIG. 5 is a top plan view of the tool of FIG. 4.

The details of the golf practice tee of this invention are best seen and understood by reference to the attached drawings showing in FIGS. 1–3 the tee, and in FIGS. 4–5 a tool for positioning the tee in the ground and for removing it from the ground.

In FIGS. 1–3 the tee itself is shown. The tee includes a central tubular body 10 which preferably is a hard plastic tube, such as polyvinylchloride pipe although it could be any other type of hard plastic pipe such as polyethylene, .polyamide, polycarbonate, polypropylene, and the like. The lower end of central tubular body 10 is plugged with a substitute hard material at 11 having a central longitudinal spike 12 extending downwardly to a point 21. Plug 11 may be wood or a plastic material. Spike 12 preferably is a steel rod having a point 21 at its lower end, threads 20 at its upper end, and a nut 13 tightened against the top of plug 11 so as to leave a short length of threads 20 extending above nut 13. The nut 13 is preferably made integral with spike 12 by an adhesive or a weld. Preferably plug 11 is adhesively joined to the inside surface of tubular body 10. Drainage holes 14 through the wall of tubular body 10 are preferred so as to permit any ground water that may leak into the center of body 10 to drain outwardly into the surrounding soil.

At the upper extremity of tubular body 10 is a rubbery elastic tube 15 to function as a golf ball support in place of a tee. The inside diameter of body 10 should be equal to or slightly smaller than the outside diameter of tube 15 so as to make it difficult for tube 15 to move axially inside body 10. Since tube 15 will be struck repeatedly by a golf club, tube 15 will tend to be pulled upwardly and out of the grip of body 10 and some step should be taken to fasten tube 15 tightly within body 10. It may be necessary to apply some type of clamp around the upper extremity of body 10 to accomplish this purpose. A suggested procedure which is shown here has been found to be successful. The wall of body 10 is cut so as to produce a flap that may be bent inwardly against tube 15. Shown here is a cut 16 in the form of the letter "H". This produces two possible flaps one above and one below the horizontal cut. Either one of these may be pushed inwardly against tube 15. As seen in FIG. 3, the tongue 17 above the horizontal cut line 16 is pushed inwardly and has deformed the tube 15 to produce a slight depression 18 which has proved to be an excellent restraint to prevent tube 15 from moving upwardly by repeated engagement with a golf club, for example. Other procedures might be used. All that is necessary is that tube 15 be frictionally deterred from freely sliding with respect to body 10. It is not desirable that the two tubes 15 and 10 be welded together, because there are times when sliding tube 15 upwardly a small amount is desirable, e.g., when continued use has damaged the upper edge 22 of tube 15 to the extent that it will not support a golf ball properly; in which event, the top edge of 22 is cut perpendicular to the apparatus length, and the top edge is repositioned with respect to ground level 19.

Figure 6:
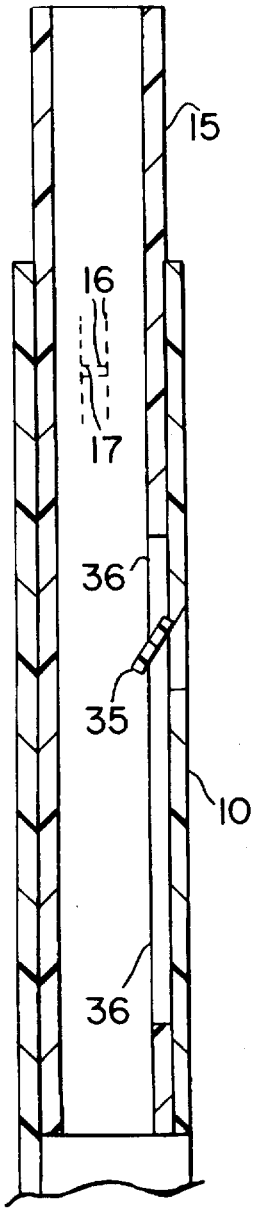
FIG. 6 is a sectional view of the golf practice tee of this invention taken along line 6—6 of FIG. 2.

Preferably, the tubular body 10 includes a stopping means in the form of a catch flange 35 which is partially cut from and pushed inwardly, as shown in FIG. 6, into an elongated slot 36 cut out of tube 15. The purpose of this stopping means is to effectively inhibit pulling the tube 15 from the body 10 and to limit the tube 15 from extending beyond the upper end of the body 10 of approximately 3" to 4". Thus, the tee tube 15 may be pushed below ground level and extend above ground level as illustrated and described in connection with FIGS. 1 and 3.

Figure 7:
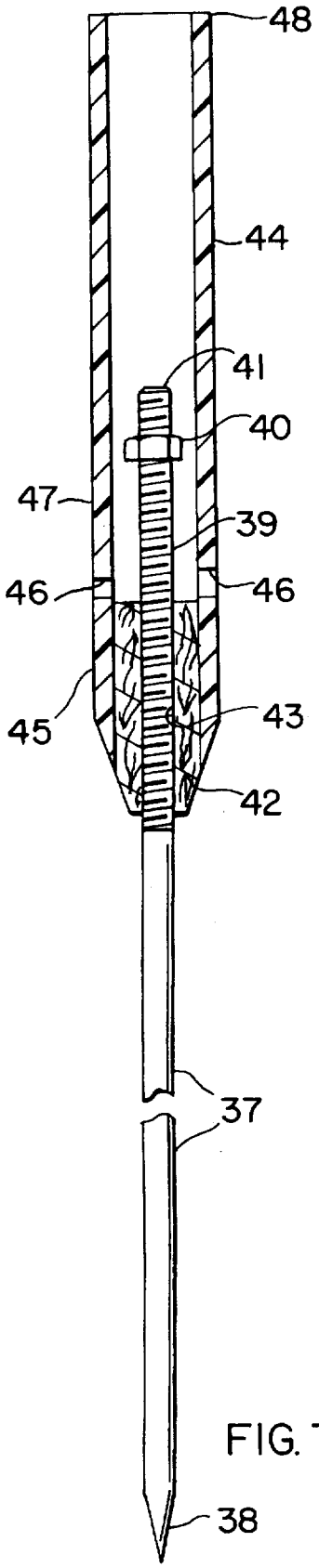
FIG. 7 is a sectional view of a simplified embodiment of the golf practice tee of this invention.

A simplified embodiment of the golf practice tee is shown in FIG. 7 and includes a spike 37 having a point 38 at its lower end and having an upper threaded portion 39 with a nut 40 being affixed thereto spaced downwardly from its upper end 41. The plug 42 has a central threaded bore 43 which is threadedly connected to upper threaded portion 39 of the spike 37. The rubbery elastic tube 44 is affixed at its lower end portion 45 to plug 42 by an adhesive or the like. Transverse holes 46 may be provided through the wall 47 of tube 44 for drainage. In use, a tool, described hereunder in connection with FIGS. 4 and 5, is threaded onto the upper end 41 and positioned in the ground. The tool is rotated to cause the spike to be rotated which causes the plug 42 to rise up on the threaded portion 39 and move the upper end 48 of tube 44 to an appropriate level above ground. To permit cutting of the grass, for example the tool must again be used to rotate the spike 37 to cause tube 44 and its plug to move downwardly as would be apparent to those having ordinary skill in the art.

A tool is shown in FIGS. 4 and 5 that is helpful in positioning the golf tee of this invention, and in removing it from the ground for repair or replacement. The tool has an elongated rod 30 as its body, with a handle portion 31 at the upper end, and a nut portion 32 at the lower end which has internal threads 33 compatible with outer threads 20 on the upper end of spike 12 (see FIGS. 1–3). This tool serves two purposes; to assist in placing the tee of this invention in the ground, and to assist in removing the tee of this invention from its position in the ground. In positioning the tee in the ground, rod 30 is extended axially into the center rod of the tee through tube 15 and body 10 to engage internal threads 33 with external threads 20 and thereby produce a solid central spine of spike 12 and rod 30 that can be hammered into the ground to the desired level where the top 22 of tube 15 is slightly above ground level 19 as shown in FIG. 3. Rod 30 may then be removed by unscrewing the connection between threads 20 and thread 33, leaving the tee of this invention properly positioned in the ground for use by a practicing golfer. Exactly the opposite may be done to remove the tee of this invention from the ground should it be necessary to do so.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to secure by Letters Patent of the United States is:

1. A golf practice tee comprising a vertical elongated tubular body having at its lower end a tapered connection to an elongated vertical spike and at its upper end a concentric flexible vertical tubing adjustably extensible lengthwise upwardly of said body, said tapered connection including a plug of connecting material joining the inside surface of said tubular body to the outside surface of said spike, said spike being threaded at its upper end which extends upwardly above an upper surface of said plug and is fitted with a nut tightened against said plug, and a vertical elongated positioning rod having at its lower end a nut threadedly engageable with said threaded upper end of said spike.

2. The tee of claim 1 wherein said tubular body includes at least one liquid drainage passageway through said tubular body adjacent said nut.

3. The tee of claim 1 wherein said vertical tubing is an elastic rubbery material.

4. The tee of claim 1 wherein said vertical tubular body is polyvinylchloride tubing.

5. The tee of claim 1 wherein said flexible vertical tubing is subjected to an external radial pressure means to restrict lengthwise movement of said flexible vertical tubing inside said tubular body.

6. A golf practice tee for emplacement in the ground comprising a central hollow tubular body having a long pointed metal spike extending vertically downward therefrom, and a flexible tubular golf ball support extending concentrically vertically upwardly therefrom; said tubular body and said spike being joined by a solid plug of material surrounding said metal spike and enclosed by said tubular body, said metal spike being threaded at its upper end and engaging a nut tightened against said plug such as to allow a short length of said threaded spike to extend upwardly of said nut; and a flexible tube extending upwardly from said hollow tubular body and being adjustable with respect to the length of said flexible tube which extends upwardly from said tubular body.

7. The golf practice tee of claim 6 wherein said central hollow tubular body has at least one passageway connecting the space in the hollow with the outside of said tubular body adjacent said nut.

8. The golf practice tee of claim 6 wherein said flexible tube is difficult to move lengthwise with respect to said hollow tubular body.

9. The golf practice tee of claim 8 which includes between the outside surface of said flexible tube and the inside surface of said hollow tubular body a means to produce a high degree of friction so as to restrict easy lengthwise movement of said flexible tube.

10. The golf practice tee of claim 6 further comprising a vertical elongated positioning rod having opposite end portions, one said end portion being detachably connected to said threaded upper end of said metal spike, said rod being adapted and arranged to install said tee into ground and to be threadedly detachable therefrom and subsequent threadedly attachable thereto to remove said tee from ground.

11. A golf practice tee for emplacement in the ground comprising a long pointed metal spike extending vertically and having opposite end portions, and a flexible tubular golf ball support extending concentrically vertically upwardly from said spike, said tubular support and said spike being joined by a solid plug of material surrounding said metal spike, said metal spike being threaded at its upper end and engaging a nut affixed to said spike such as to allow a short length of said threaded spike to extend upwardly above said nut, said flexible tubular support extending upwardly and being adjustable in height with respect to the length of said spike.

12. The golf practice tee of claim 11 wherein said tubular support has at least one passageway connecting the space in the hollow with the outside of said tubular support adjacent said nut.

13. The golf plactice tee of claim 6 further including a rigid hollow tubular body surrounding said tubular support, and being affixed to said plug, brake means between said body and said support to produce a high degree of friction so as to restrict easy lengthwise movement of said flexible support.

14. The golf practice tee of claim 13 further comprising a vertical elongated positioning rod having opposite end portions, one said end portion being detachably connected to said threaded upper end of said metal spike, said rod being adapted and arranged to install said tee into ground and to be threadedly detachable therefrom and subsequent threadedly attachable thereto to remove said tee from ground.

15. The golf practice tee of claim 13 further comprising stop means between said body and said support to limit the extent of lengthwise movement therebetween.

16. The golf practice tee of claim 15 wherein said stop means includes a vertical slot in said tubular support and an inwardly directed flange on said body engaged within said slot.

17. The golf practice tee of claim 9 wherein said stop means includes a vertical slot in said tubular support and an inwardly directed flange on said body engaged within said slot.

* * * * *